US008585957B2

(12) United States Patent
Jeong et al.

(10) Patent No.: US 8,585,957 B2
(45) Date of Patent: Nov. 19, 2013

(54) METHOD OF MANUFACTURING NANO-FIBER NON-WOVEN FABRICS

(75) Inventors: Phil Jung Jeong, Gyeonggi-do (KR); Seung Soo Ryu, Gyeonggi-do (KR); Jun Mo Ku, Gyeonggi-do (KR); Hee Jun Jeong, Gyeonggi-do (KR); Joo Yong Kim, Seoul (KR); Min Ki Choi, Incheon (KR); Jung Yeol Kim, Seoul (KR)

(73) Assignees: Hyundai Motor Company, Seoul (KR); Kia Motors Corporation, Seoul (KR); Soongsil University Research Consortium techno-Park, Seoul (KR)

( * ) Notice: Subject to any disclaimer, the term of this patent is extended or adjusted under 35 U.S.C. 154(b) by 266 days.

(21) Appl. No.: 13/075,637

(22) Filed: Mar. 30, 2011

(65) Prior Publication Data

US 2012/0115386 A1 May 10, 2012

(30) Foreign Application Priority Data

Nov. 9, 2010 (KR) ..... 10-2010-0111185

(51) Int. Cl.

| | |
|---|---|
| ***D01F 1/10*** | (2006.01) |
| ***D01F 6/70*** | (2006.01) |
| ***D06M 10/00*** | (2006.01) |
| ***H05B 6/00*** | (2006.01) |

(52) U.S. Cl.
USPC ..... 264/465; 264/211

(58) Field of Classification Search
USPC ..... 264/211, 464, 465, 466, 484
See application file for complete search history.

(56) References Cited

U.S. PATENT DOCUMENTS

| | | | | |
|---|---|---|---|---|
| 4,043,331 | A * | 8/1977 | Martin et al. | 602/45 |
| 5,643,489 | A * | 7/1997 | Jong | 252/1 |
| 2002/0102893 | A1* | 8/2002 | Petrea et al. | 442/123 |
| 2007/0264520 | A1* | 11/2007 | Wood et al. | 428/606 |
| 2008/0110342 | A1 | 5/2008 | Ensor et al. | |
| 2008/0274320 | A1* | 11/2008 | Yokoyama et al. | 428/36.92 |
| 2010/0093093 | A1* | 4/2010 | Leong et al. | 264/465 X |
| 2010/0233812 | A1* | 9/2010 | Sun et al. | 435/401 |
| 2011/0049939 | A1* | 3/2011 | Ryu et al. | 296/214 |

FOREIGN PATENT DOCUMENTS

| | | | |
|---|---|---|---|
| EP | 2204480 | A1 | 7/2010 |
| JP | 2008127496 | A | 6/2008 |
| KR | 10-2006-0048009 | | 5/2006 |
| KR | 10-2008-0098115 | | 11/2008 |

* cited by examiner

*Primary Examiner* — Leo B Tentoni
(74) *Attorney, Agent, or Firm* — Edwards Wildman Palmer LLP; Peter F. Corless

(57) ABSTRACT

A method of manufacturing nano-fiber non-woven fabrics is provided. The method comprises preparing a polyurethane solution by dissolving polyurethane in an organic solvent, producing an electrospinning solution by adding far infrared ray emitting particles, antibacterial inorganic particles, and deodorization inorganic particles to the polyurethane solution, and electrospinning the electrospinning solution to form the nano-fiber non-woven fabric. The far infrared ray emitting particles may be obtained by adding a metal oxide to ceramics and sintering the metal oxide-added ceramics. The antibacterial inorganic particles may be obtained by impregnating a zirconium-based carrier with silver ions. The deodorization inorganic particles may be obtained by impregnating a zirconium-based or a silica oxide-based carrier with an amine-based compound.

4 Claims, 4 Drawing Sheets

METHOD OF MANUFACTURING NANO-FIBER NON-WOVEN FABRICS

CROSS-REFERENCE TO RELATED APPLICATION

This application claims under 35 U.S.C. §119(a) the benefit of Korean Patent Application No. 10-2010-0111185 filed Nov. 9, 2010, the entire contents of which are incorporated herein by reference.

BACKGROUND (a) Technical Field

The present invention generally relates to a method of manufacturing nano-fiber non-woven fabrics, and more specifically to a method of manufacturing nono-fiber non-woven fabrics mixed with inorganic particles. Such fabrics are particularly useful as an interior material of a vehicle.

(b) Background Art

As vehicles become a primary means of transportation, people spend an increasing amount of time in their cars. In fact, vehicles are often considered more of a living space than a transportation means. Accordingly, there has been a growing interest in improving the air quality for passengers within vehicles. Since major causes of air pollution within vehicles are due to the presence of molds, bacteria, and odorous gases, many car makers have been attempting to use functional interior materials with antibacterial or deodorization functions as interior materials of a vehicle.

Korean Patent No. 10-0073862 describes a method for manufacturing an antibacterial resin, wherein an antibacterial organic compound is mixed while processing the resin. This method, however, is undesirable because the antibacterial organic material is poisonous, has an effect only on certain bacteria, and the antibacterial effects generally do not last long due to elution.

In attempt to resolve these problems, an antibacterial resin has been manufactured wherein an inorganic antibacterial agent containing a metal component with antibacterial activity is mixed during the resin processing. Examples of metals showing antibacterial activity include silver, copper, zinc, etc. An inorganic material for supporting the metal includes zeolite, talc, hydroxyapatite, silica gel, or activated charcoal. Silver or a mixture of silver and other antibacterial metals exhibit excellent antibacterial activity, but are disadvantageous in terms of discoloration of the resin and processing stability. Thus, there is a trade-off between color stability and antibacterial activity. In particular, while an antibacterial agent having a poor antibacterial activity rarely discolors the resin, an antibacterial agent with excellent antibacterial activity will generally cause a serious color change of the resin.

In an attempt to solve such problems, Korean Patent No. 10-0048670 describes the use of zeolite substituted with ammonium ions and an anti-discoloration agent. However, this method is not sufficient to prevent discoloration. Further, this resin is foamed due to emission of ammonia by heat, which is problematic.

Korean Patent No. 10-0086520 suggests a method of coating liquid paraffin on a surface of an inorganic antibacterial agent to overcome such problems. However, this method requires additional processes, which lead to increase in costs. Further, it is difficult to form coating layers having a uniform thickness or degree.

Japanese Patent Application Publication No. H4-275370 describes a method using a phosphate-based inorganic antibacterial agent having a strong bond with an antibacterial metal component and a supporting material to prevent discoloration. However, while stability of the antibacterial agent itself is increased, oxidation/reduction of the antibacterial agent is increased due to interaction with the additive used for enhancing physical properties.

SUMMARY OF THE DISCLOSURE

The present invention has been made in an effort to solve the above-described problems. Applicants found that an excellent antibacterial activity of a resin can be secured without discoloration of the resin when using a predetermined concentration of an antibacterial agent, wherein the antibacterial agent is obtained by impregnating a zirconium-based carrier with antibacterial inorganic particles. In particular, according to the present invention, nano-fiber non-woven fabrics may be produced by electrospinning a solution that contains the antibacterial agent, far infrared ray emitting particles, and a deodorization agent obtained by impregnating an inorganic compound with an amine-based compound. The nano-fiber non-woven fabrics of the present invention are provided with far infrared ray emission, antibacterial activity, and deodorization features. For example, according to various embodiments, the fabrics and particularly the deodorization agent reacts with aldehyde to thereby remove malodor.

Exemplary embodiments of the present invention provide a method of manufacturing an inorganic particles-mixed nano-fiber non-woven fabric having far infrared emission, as well as antibacterial and deodorization functions through a simple process.

According to an embodiment of the present invention, there is provided a method of manufacturing nano-fiber non-woven fabrics comprising: preparing a polyurethane solution by dissolving polyurethane in an organic solvent; adding far infrared ray emitting particles, antibacterial inorganic particles, and deodorization inorganic particles to the polyurethane solution to produce an electrospinning solution, and electrospinning the electrospinning solution to form the nano-fiber non-woven fabric. In particular, according to various embodiments, the far infrared ray emitting particles are obtained by combining a metal oxide and one or more ceramics, and sintering the metal oxide/ceramics mixture to form the far infrared ray emitting particles. Such methods for forming far infrared ray emitting particles are known in the art and, thus, the present methods can be in accordance with any of these known methods Further, the one or more ceramics and metal oxides can be selected from any known ceramic materials and metal oxides useful in the formation of far infrared ray emitting particles, and are not particularly limited. According to some embodiments of the present invention, the far infrared ray emitting particles are commercially available far infrared ray emitting particles. According to various embodiments, the antibacterial inorganic particles can be obtained by impregnating a zirconium-based carrier with silver ions. According to various embodiments, the deodorization inorganic particles can be obtained by impregnating a carrier, such as a zirconium-based or a silica oxide-based carrier, with an amine-based compound.

According to some embodiments of the present invention, the nano-fiber non-woven fabric contains inorganic particles mingled with strands of fiber. The strands of fiber are suitably sized, and can be provided so as to be uniformly sized or they can vary in size. For example, according to some embodiments, the strands of fiber can be sized so as to each have a fiber diameter of 200 to 400 nm. In accordance with the present invention, the surface area of inorganic particles that contact air increases, to thereby maximize effects by the inorganic particles and durability of the fabric. According to embodiments of the present invention, it is possible to obtain nano-fiber non-woven fabrics having excellent antibacterial and deodorization features as well as high far infrared emission performance. The thus manufactured non-woven fabrics may be beneficially used to prepare interior materials of a vehicle.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DETAILED DESCRIPTION

Figure 1:
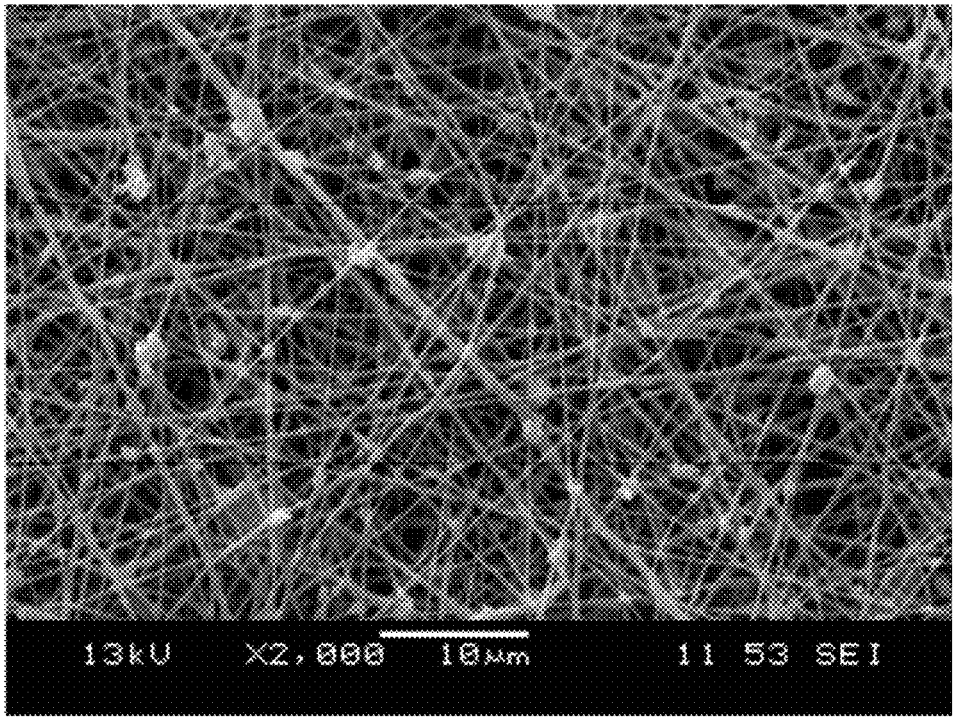
FIG. 1 is an SEM image of nano-fiber non-woven fabrics manufactured according to an embodiment of the present invention (×2,000)
Figure 2:
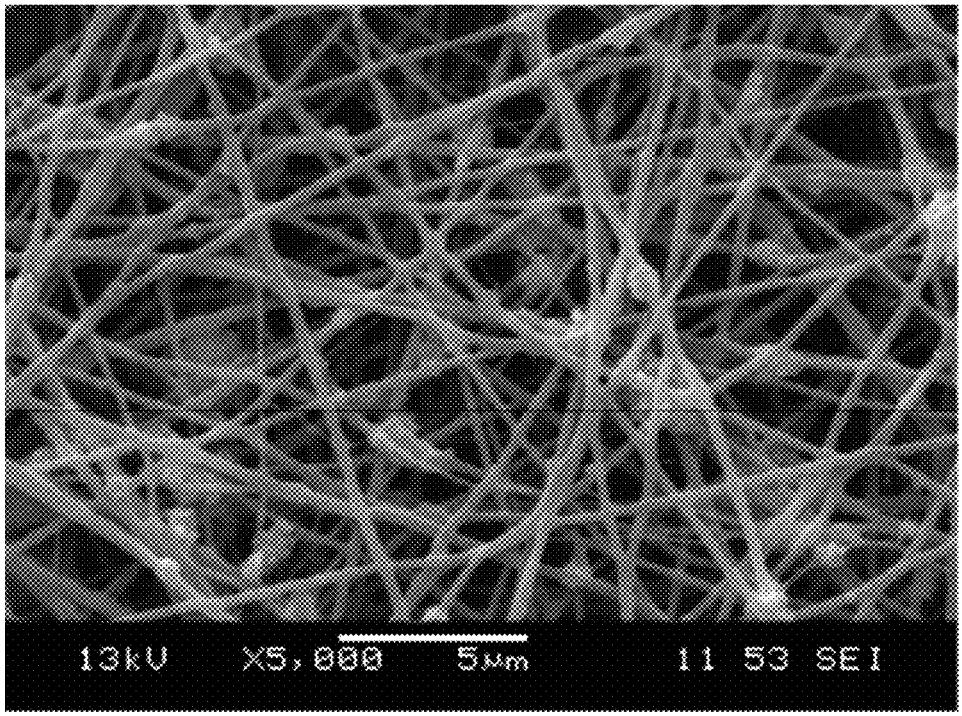
FIG. 2 is an SEM image of nano-fiber non-woven fabrics manufactured according to an embodiment of the present invention (×5,000)
Figure 3:
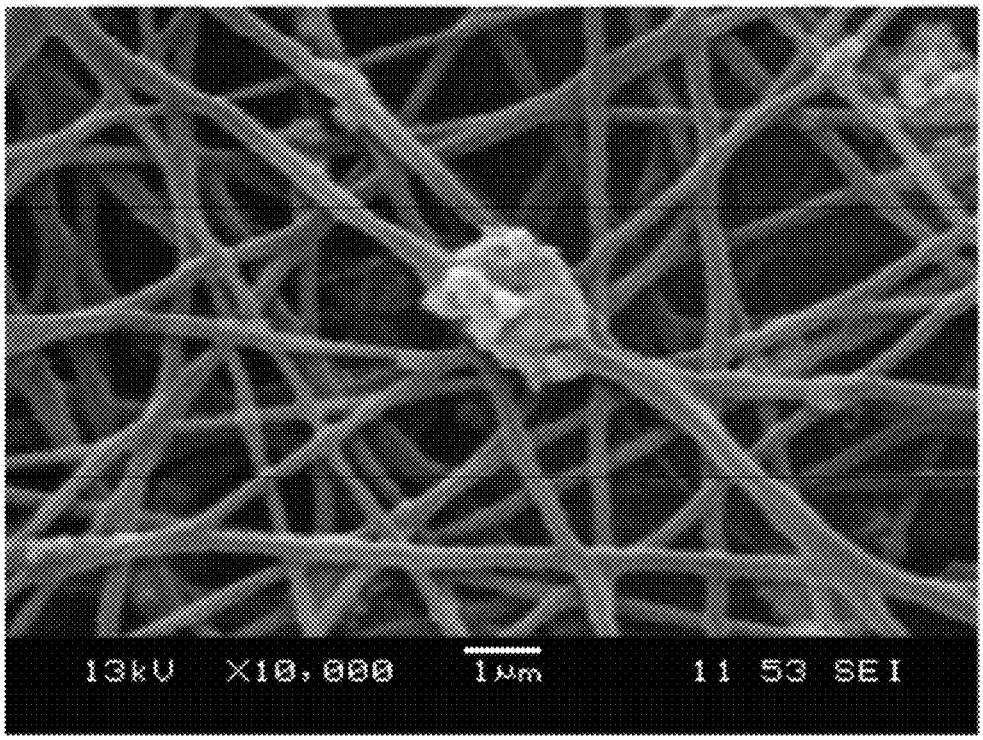
FIG. 3 is an SEM image of nano-fiber non-woven fabrics manufactured according to an embodiment of the present invention (×10,000)

Embodiments of the present invention will be described in greater detail with reference to the accompanying drawings.

The present invention generally relates to a method of manufacturing improved nano-fiber non-woven fabrics. More particularly, according to embodiments of the present invention, improved nano-fiber non-woven fabrics are provided by electrospinning an electrospinning solution that is obtained by adding functional inorganic particles to an organic solvent, wherein the functional inorganic particles are preferably insoluble in the organic solvent. In accordance with some embodiments, the organic solvent can include far infrared ray emitting particles, antibacterial inorganic particles, and deodorization inorganic particles within a polyurethane solution.

According to some embodiments, the polyurethane solution can be prepared by dissolving polyurethane in an organic solvent. Any suitable organic solvent can be used, and according to certain embodiments the organic solvent is a mixture of N-N dimethylformamide (DMF) and methylethylketone (MEK). In particular, N-N dimethylformamide and methylethylketone can be mixed at a ratio of about 1:1 to 2 wt. When the content of N-N dimethylformamide is too small, an electrospinning tip may become clogged, while beads may be created if the content is too large. According to certain preferred embodiments, the concentration of polyurethane within the organic solvent may be maintained in a range from about 10 to 20 wt %. When the concentration of polyurethane is low, for example less than 10 wt %, beads may be created. On the other hand, if the concentration is high, for example more than 20 wt %, the tip may become clogged, thus causing problems in the process.

According to embodiments of the present invention, an electrospinning solution is produced by adding far infrared ray emitting particles, antibacterial inorganic particles, and deodorization organic particles to the polyurethane solution.

The far infrared ray emitting particles preferably have a uniform particle size. According to some embodiments, micron sized or sub-micron sized particles are used. For example, far infrared ray emitting particles can be provided that are no greater than 1 μm, more preferably no greater than about 0.5 μm, and, in accordance with an exemplary embodiment, about 0.3 μm If the particle size is not uniform, problems with far infrared ray emission performance may occur. According to some embodiments, ceramics obtained by adding and sintering a metal oxide material may be used to satisfy conditions for a far infrared emission material. In some embodiments, any commercially available materials, such as platinum photon (available from Platinum Photon Corporation located in Japan) or the like can suitably be used.

According to various embodiments, the antibacterial particles can be inorganic particles obtained by impregnating a zirconium phosphate-based carrier with silver ions. A phosphate-based inorganic antibacterial agent beneficially provides a strong bond between an antibacterial metal and a carrier, and thus demonstrates excellent stability necessary for use in a vehicle interior. However, phosphate-based inorganic antibacterial agents generally interact with additives and, thus, have problems of discoloration of the resin. According to various embodiments, a zirconium phosphate-based inorganic antibacterial agent was selected, which provides excellent discoloration resistance, antibacterial activity and thermal resistance, and further is capable of maintaining stability and continuity of phosphate-based materials. Further, the zirconium phosphate-based inorganic antibacterial agent is suitable for interior materials of a vehicle and meets processing conditions of electrospinning. According to an exemplary embodiment, NOVARON (AGZ010, commercially available from Toagosei Co., located in Japan) containing 1 wt % of silver ions may be used as the zirconium phosphate-based inorganic antibacterial agent.

According to various embodiments of the invention, the deodorization inorganic particles can be obtained by impregnating an inorganic compound carrier with an amine compound. In some embodiments, the inorganic compound carrier may include a zirconium phosphate-based or silica oxide-based inorganic compound in terms of electrospinning conditions and deodorization effects. The deodorization inorganic particles are preferably selected from any that chemically react with formaldehyde, ammonia, or acetaldehyde to remove malodor, thereby reducing volatile organic compounds generated from interior material of vehicle. For example, KESMON (NS-231, commercially available from Toagosei Co., Japan) may be used as the deodorization inorganic particles.

The far infrared ray emitting particles, the antibacterial inorganic particles, and the deodorization inorganic particles are provided in the present compositions in suitable amounts. According to some embodiments, each type of particle can be individually included in an amount no greater than about 10 wt %, more preferably no greater than about 8 wt %, and more preferably no greater than about 7 or 6 wt %.

In a preferred embodiment, the far infrared ray emitting particles are present at about 2 to 4 wt %, the antibacterial inorganic particles are present at about 1 to 4 wt %, and the deodorization inorganic particles are present at about 2 to 6 wt %. When the content of the particles is too small, it may be difficult to obtain the desired effects, such as far infrared ray emission, antibacterial activity, and deodorization effects. When the content of the particles is too large, problems with uniformity of electrospinning and formation of the fiber may occur. According to some embodiments, the three types of particles can be included in an amount of such that the total content of these particles is no greater than about 20 wt %, and more preferably no greater than about 15 wt %. In some embodiments, it may be advantageous to maintain the contents of the particles so that the total content of the three types of particles is not more than 10 wt % so as to, for example, avoid problems with electrospinning. According to embodiments of the present invention, by maintaining the contents of particles within desired ranges, far infrared ray emission of 99% or more, antibacterial performance of 99% or more, deodorization performance of 80%, 99%, 80%, and 80% or more for formaldehyde, ammonia, acetic acid, and acetaldehyde may be achieved without affecting electrospinning conditions.

According to the present invention, nano-fiber non-woven fabrics are obtained by electrospinning the electrospinning solution. Electrospinning may be used for a very broad range of high molecular materials. Further, materials difficult to spin in an electrospinning process, such as metal or carbon, may be mixed together with a suitable material, such as a high molecular solution, and electrospun together to thereby easily obtain a fiber web. Further, the electrospinning process may be performed even with a tiny amount of high molecular solution. As further described above, functional inorganic particles not soluble in an organic solvent may be mixed with the polyurethane solution and the mixture may be electrospun, thus providing non-woven fabrics having features of far infrared emission, antibacterial activity, and deodorization effects. The fabric thus manufactured can further be provided (e.g. by suitable selection of materials) so as to have a diameter of a few to a few hundreds of nanometers, i.e., a very large surface area. As known in the art, an electrospinning process is affected by voltage and/or atmospheric conditions of the surroundings. Thus, for example, according to embodiments of the present invention conditions can be chosen to provide particular results. For example, in an exemplary embodiment, the electrospinning may be performed under a voltage of about 15 to 20V, a relative humidity of about 50 to 60%, and a temperature of about 20 to 25° C. When voltage is outside a desired range, it may be difficult to form the fabric or the diameter of the fabric may be thickened, thus reducing the surface area below a desired surface area. When relative humidity and temperature are outside of a desired range, such as the above-mentioned ranges, it can be difficult to obtain a fabric with a uniform thickness, and beads may be created. Under the above conditions, for example, a non-woven fabric having a fabric diameter of 200 to 400 nm may be obtained by electrospinning.

According to the present method of manufacturing nano-fiber non-woven fabrics, inorganic particles that are not dissolved in an organic solvent are mixed and electrospun with a high molecular solution, thereby producing non-woven fabrics that have excellent antibacterial activity and which do not exhibit discoloration of resin.

Further, the thus manufactured non-woven fabrics have excellent far infrared ray emission efficiency and deodorization property, and therefore, may be useful for the preparation of interior materials of a vehicle.

Various embodiments of the present invention will now be described in more detail in connection with the following Examples. However, the present invention is not limited thereto.

EXAMPLE 15 wt % of polyurethane was dissolved in an organic solvent obtained by mixing N-N dimethylformamide and methylethylketone in a weight ratio of 1:1.5, thus obtaining a polyurethane solution. Far infrared ray emitting particles (in this example, Platinum photon commercially available from Platinum Photon Corporation located in Japan was used), antibacterial inorganic particles (in this example, NOVARON (AGZ010) commercially available from Toagosei Co., located in Japan was used), and deodorization inorganic particles (in this example, KESMON(NS-231) commercially available from Toagosei Co., located in Japan was used) were added in the polyurethane solution, thus producing an electrospinning solution. The concentrations of the three types of particles were 3 wt %, respectively. The thus manufactured electrospinning solution was electrospun on a surface of a vehicular head liner under the following conditions: a voltage of 18.7V, a relative humidity of 54%, and a temperature of 24° C., thus producing nano-fiber non-woven fabrics in accordance with the present invention.

Comparative Example

This comparative example was carried out the same as in the above Example except that the far infrared ray emitting particles, the antibacterial inorganic particles, and the deodorization inorganic particles, respectively, had a concentration of 1 wt % each.

Test for Measuring Physical Properties (1) Evaluation of Antibacterial Activity

Antibacterial activity against *staphylococcus aureus* ATCC6358 and *klebsiella pneumoniae* ATCC4352 was measured using an AATCC 100 test method to quantitatively evaluate antibacterial performance of the nano-fiber non-woven fabric.

TABLE 1

| Bacteria | Comparative Example | Example |
|---|---|---|
| *Staphylococcus aureus* | 99.9% | 99.9% |
| *Klebsiella pneumoniae* | 97.8% | 99.9% |

Figure 4:
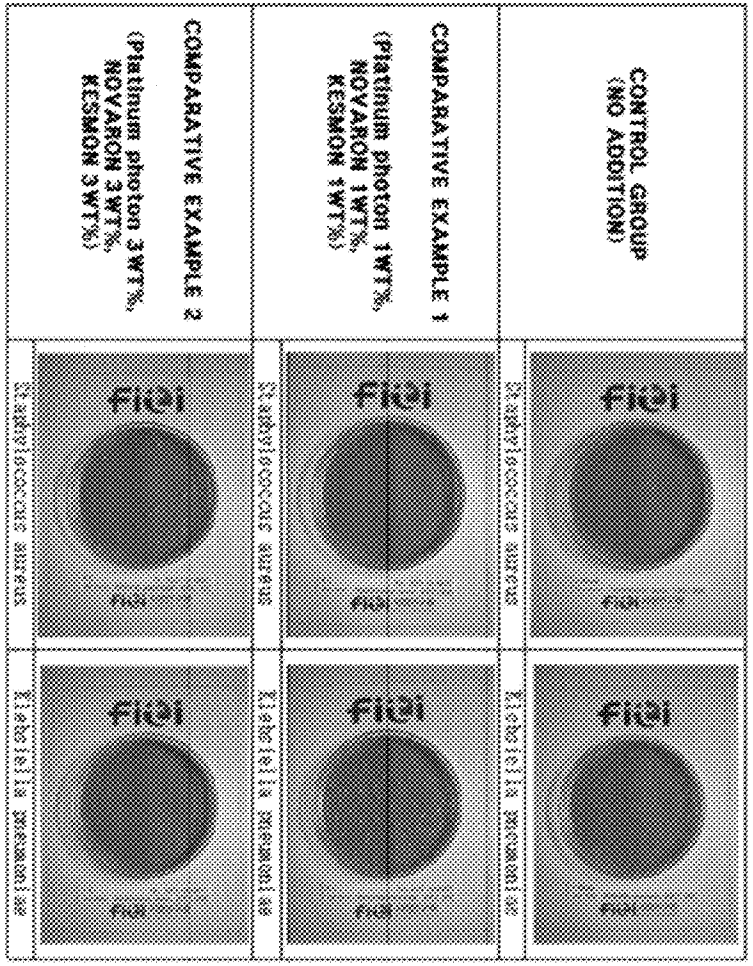
FIG. 4 shows test results obtained by performing an AATCC 100 test on nano-fiber non-woven fabrics manufactured according to a comparative example and an embodiment of the present invention.

FIG. 4 shows inoculation media under the AATCC 100 test method. Table 1 above shows numerical results. The two non-woven fabrics both showed a bacteria reduction rate of more than 97% with very excellent antibacterial activity.

(2) Evaluation of Deodorization

A gas detector tube method (test gas: formaldehyde) was used to measure deodorization performance of the non-woven fabrics manufactured according to the example and the comparative example.

TABLE 2

| Test Hour | Comparative Example | Example |
|---|---|---|
| 30 min. | 65% | 92% |
| 60 min. | 60% | 93% |

Table 2 above shows measurement results of deodorization rates of formaldehyde. The fabric made in accordance with the comparative example demonstrated a deodorization rate of about 60%, which fails to reach the deodorization rate of 80% or more that is required for use as interior materials of a vehicle. However, the fabric made in accordance with example (in accordance with the present invention) demonstrated an excellent deodorization rate of more than 90% in 30 minutes, thus meeting the requirements for interior materials of a vehicle.

Thus, the nano-fiber non-woven fabrics manufactured according to the embodiments of the present invention demonstrate both excellent antibacterial activity and deodorization performance, and thereby may be suitably used as interior materials of a vehicle.

The invention has been described in detail with reference to the embodiments thereof. However, it will be appreciated by those skilled in the art that changes may be made in these embodiments without departing from the principles and spirit of the invention, the scope of which is defined in the appended claims and their equivalents.

What is claimed is:

1. A method of manufacturing nano-fiber non-woven fabrics comprising:

preparing a polyurethane solution by dissolving polyurethane in an organic solvent;

adding far infrared ray emitting particles, antibacterial inorganic particles, and deodorization inorganic particles to the polyurethane solution to produce an electrospinning solution, wherein the far infrared ray emitting particles are obtained by sintering a combination of one or more a metal oxide and one or more ceramic materials, the antibacterial inorganic particles are obtained by impregnating a zirconium-based carrier with silver ions, and the deodorization inorganic particles are obtained by impregnating a zirconium-based or a silica oxide-based carrier with an amine-based compound; and electrospinning the electrospinning solution to form the nano-fiber non-woven fabric, wherein the electrospinning solution comprises about 2 to 4 wt % of the far infrared ray emitting particles, about 1 to 4 wt % of the antibacterial inorganic particles, about 2 to 6 wt % of the deodorization inorganic particles, based on total weight of the electrospinning solution.

2. The method of claim 1, wherein the organic solvent is prepared by mixing N-N dimethylformamide and methylethylketone in a weight ratio of about 1:1 to 2.

3. The method of claim 1, wherein the polyurethane solution includes about 10 to 20 wt % polyurethane.

4. The method of claim 1, wherein the electro spinning is performed at about 20 to 25° C. with 15 to 20V of voltage and 50 to 60% of relative humidity.

* * * * *